US006631577B1

(12) United States Patent
Madison

(10) Patent No.: US 6,631,577 B1
(45) Date of Patent: Oct. 14, 2003

(54) VEHICLE FUELING SAFETY SYSTEM AND METHOD

(76) Inventor: Kevin Madison, 9-04 Harristown Rd., Fair Lawn, NJ (US) 07410

( * ) Notice: Subject to any disclaimer, the term of this patent is extended or adjusted under 35 U.S.C. 154(b) by 0 days.

(21) Appl. No.: 09/915,168

(22) Filed: Jul. 25, 2001

(51) Int. Cl.[7] ..... G09F 21/04
(52) U.S. Cl. ..... 40/591
(58) Field of Search ..... 40/591, 643, 644, 40/593, 597; 296/21; 340/425.5, 450.2, 473, 471

(56) References Cited

U.S. PATENT DOCUMENTS

| | | | | | |
|---|---|---|---|---|---|
| 3,237,330 | A | * | 3/1966 | Dinstbir | 116/28 R |
| 3,670,438 | A | | 6/1972 | Carroll et al. | |
| 4,607,444 | A | | 8/1986 | Foster | |
| 4,736,539 | A | * | 4/1988 | Dickinson | 40/200 |
| 4,860,476 | A | * | 8/1989 | Hall | 40/547 |
| 4,953,315 | A | * | 9/1990 | Romaine | 116/44 |
| 4,955,153 | A | | 9/1990 | Albrecht et al. | |
| 5,226,792 | A | | 7/1993 | Darago | |
| 5,241,768 | A | * | 9/1993 | Thompson | 40/593 |
| 5,263,272 | A | | 11/1993 | Fogelman | |
| 5,398,437 | A | | 3/1995 | Bump, Jr. et al. | |
| 5,503,891 | A | | 4/1996 | Marshall et al. | |
| 5,671,491 | A | | 9/1997 | Ladd | |
| 5,960,572 | A | * | 10/1999 | DeVito | 248/206.2 |
| 6,163,997 | A | * | 12/2000 | Deralas | 40/593 |
| 6,446,375 | B1 | * | 9/2002 | Davis | 40/591 |

* cited by examiner

*Primary Examiner*—William L. Miller
(74) *Attorney, Agent, or Firm*—Arthur Jacob

(57) ABSTRACT

A vehicle fueling safety system, device and method precludes inadvertent premature departure of a vehicle from a fueling station having a fuel dispenser, as a result of an action by an inattentive or distracted driver of the vehicle during an ongoing fueling operation by placing a visual warning indicator in the line-of-sight of the driver when the driver is in a driving position in the vehicle during the ongoing fueling operation. The indicator reminds the driver not to move the vehicle until the indicator is removed, indicating that fueling is complete and it is safe to move the vehicle. A further feature places the indicator at an inactive location remote from the line-of-sight, when not in use, and a disabling arrangement is responsive to such placement for disabling the fuel dispenser to preclude the dispensing of fuel when the indicator is at the inactive location.

18 Claims, 10 Drawing Sheets

VEHICLE FUELING SAFETY SYSTEM AND METHOD

BACKGROUND OF THE INVENTION

1. Field of the Invention

The present invention relates generally to the fueling of vehicles at a fueling station and pertains, more specifically, to a vehicle fueling safety system, device and method for precluding inadvertent premature departure of a vehicle from the fueling station as a result of the actions of an inattentive or distracted driver of the vehicle during an ongoing fueling operation.

2. Description of the Related Art

Conventional motor vehicle fueling operations at a fueling station usually involve driving the vehicle into proximity with a fuel dispenser, in the form of a fuel pump, and then connecting the fuel pump with the fuel tank of the vehicle, through a dispensing hose and a nozzle coupled with a filler neck provided in the vehicle, and communicating with the fuel tank. Accidents have occurred when a driver of a vehicle being fueled inadvertently drives away from the fuel pump, either as a result of inattention or distraction, while the fueling operation is ongoing, and the nozzle still is coupled with the filler neck. In such instances, the nozzle can be pulled from the filler neck while fuel is still being dispensed, resulting in the spilling of fuel and a concomitant hazardous condition at the site. In worse situations, the dispensing hose is torn from the fuel dispenser with the result that not only is fuel spewed over a wider area, but flying parts create further damage to structures and vehicles in the area, as well as injury to persons. Various safety devices have been designed to preclude, or at least reduce, the deleterious effects of such premature departure of a vehicle during an ongoing fueling operation; however, these devices have not been found completely effective in eliminating the havoc associated with such occurrences.

BRIEF SUMMARY OF THE INVENTION

The present invention provides a vehicle fueling safely system, device and method for precluding inadvertent premature departure of a vehicle from a fueling station during an ongoing fueling operation, as a result of the action of an inattentive or distracted driver of the vehicle. As such, the present invention attains several objects and advantages, some of which are summarized as follows: Precludes inadvertent premature departure of a vehicle from a fueling station by reminding the driver of the vehicle that a fueling operation is incomplete and ongoing; places a visible reminder in the line-of-sight of the driver of a vehicle at a fueling station so as to deter premature departure of the vehicle; prevents hazardous conditions at a fueling station and eliminates damage to property and injury to people in the vicinity, which otherwise has been known to occur as a result of premature departure of a vehicle from a fueling station; provides an inexpensive system and method which require little if any modification of existing sites to reduce accidents resulting from the premature departure of a vehicle being fueled at a fueling station; presents a unique medium for advertising goods and services or for otherwise entertaining a driver during fueling of the driver's vehicle; provides a relatively simple and highly effective system and method for increasing safety at a fueling station with relatively little effort on the part of drivers or attendants at the fueling station; reduces hazards associated with premature departure of a vehicle from a fueling station; decreases losses associated with fueling operations by assuring completion of all transactions in the fueling operation before departure of a vehicle being fueled; provides increased safety and efficiency at both self-serve and attendant-operated vehicle fueling stations, for encouraging widespread adoption and use.

The above objects and advantages, as well as further objects and advantages, are attained by the present invention which may be described briefly as a vehicle fueling safety system for precluding inadvertent premature departure of a vehicle from a fueling station as a result of an action by an inattentive or distracted driver of the vehicle during an ongoing fueling operation in which fuel is dispensed to the vehicle from a fuel dispenser at the fueling station, the vehicle fueling safety system comprising: a visual warning indicator for being viewed by the driver as a reminder of the ongoing fueling operation; a placement device for selective placement of the visual warning indicator in a line-of-sight of the driver when the driver is in a driving position in the vehicle during the ongoing fueling operation, and for selective removal of the visual indicator from the line-of-sight upon completion of the ongoing fueling operation; a further placement device for placement of the visual warning indicator at an inactive location outside the line-of-sight; and a disabling arrangement responsive to placement of the visual warning indicator at the inactive location for disabling the fuel dispenser to preclude the dispensing of fuel while the visual warning indicator is placed at the inactive location.

In addition, the present invention includes a vehicle fueling safety device for precluding inadvertent premature departure of a vehicle from a fueling station as a result of an action by an inattentive or distracted driver of the vehicle during an ongoing fueling operation at the fueling station, the vehicle fueling safety device comprising: a visual warning indicator for being viewed by the driver as a reminder of the ongoing fueling operation; and a placement device for selective placement of the visual warning indicator in a line-of-sight of the driver when the driver is in a driving position in the vehicle during the ongoing fueling operation, and for selective removal of the visual indicator from the line-of-sight upon completion of the ongoing fueling operation.

Further, the invention includes a vehicle fueling safety method for precluding inadvertent premature departure of a vehicle from a fueling station as a result of an action by an inattentive or distracted driver of the vehicle during an ongoing fueling operation at the fueling station, the vehicle fueling safety method comprising the steps of: providing a visual warning indicator for being viewed by the driver as a reminder of the ongoing fueling operation; selectively placing the visual warning indicator in a line-of-sight of the driver when the driver is in a driving position in the vehicle during the ongoing fueling operation; and selectively removing the visual indicator from the line-of-sight upon completion of the ongoing fueling operation.

BRIEF DESCRIPTION OF THE SEVERAL VIEWS OF THE DRAWING

The invention will be understood more fully, while still further objects and advantages will become apparent, in the following detailed description of preferred embodiments of the invention illustrated in the accompanying drawing, in which.

DETAILED DESCRIPTION OF THE INVENTION

Figure 1:
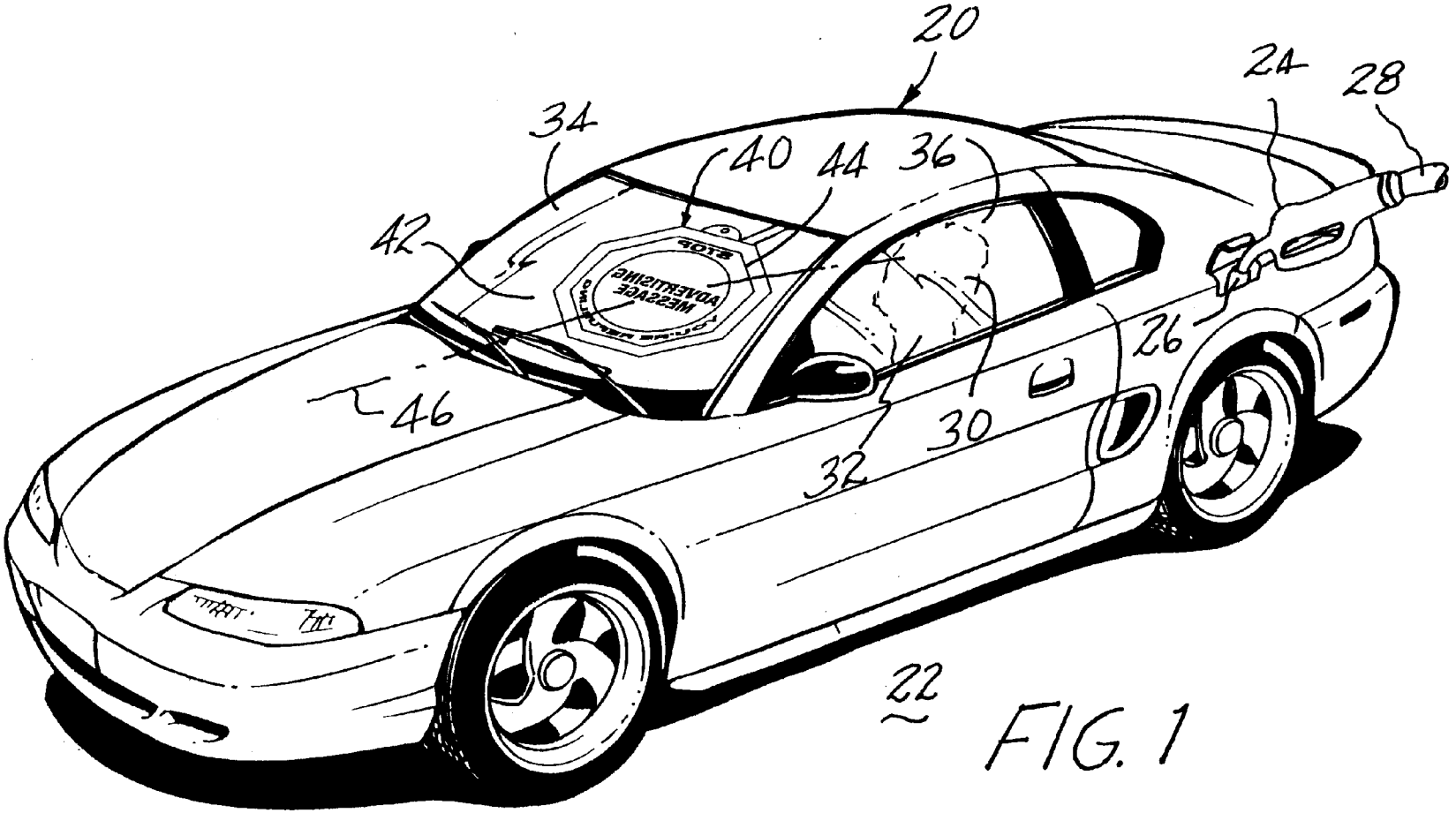
FIG. 1 is a pictorial view of a vehicle being fueled and illustrating one application of the present invention.

Referring now to the drawing, and especially to FIG. 1 thereof, a vehicle in the form of an automobile 20 is shown being fueled at a fueling station 22. A fueling nozzle 24 has been inserted into a filler neck 26 which communicates with the fuel tank (not shown) of the automobile 20 in order to couple a fueling hose 28 to the fuel tank during the fueling operation, in a conventional manner. The fueling hose 28, in turn, is coupled to a fuel dispenser in the form of a conventional fuel pump (see FIG. 11). The driver of the automobile 20 is shown at 30 and remains in a driving position 32 within the automobile 20 during the fueling operation. The automobile 20 further includes windows in the form of a windshield 34 immediately ahead of the driving position 32, and a side window 36 beside the driving position 32.

Accidents have been known to occur when the driver 30, either through inattention or distraction, believes that the fueling operation is complete and drives the automobile away while, in fact, the fueling operation is ongoing and the nozzle 24 still is lodged in the filler neck 26. Such inadvertent premature departure of the automobile 20 can dislodge the nozzle 24 and cause fuel to spill from the nozzle 24, thereby establishing a hazardous condition at the fueling station 22. In an even worse scenario, the hose 28 can be torn completely from the fuel pump, resulting in havoc, including flying parts and spewed fuel throughout the vicinity.

In order to preclude such inadvertent premature departure of the automobile 20, and the concomitant accidental disastrous occurrences outlined above, a vehicle fueling safety device constructed in accordance with the present invention, shown at 40, has been placed on the automobile 20. In this instance, safety device 40 is placed upon outside surface 42 of the windshield 34 by an attendant (not shown) who conducts the fueling operation at the fueling station 22. The safety device 40 includes a visual warning indicator in the form of a visual display 44 and is secured to the automobile 20 so that the visual display 44 is located directly in the line-of-sight 46 of the driver 30 placed at the driving position 32. The safety device 40 remains in place against the windshield 34 throughout the duration of the fueling operation and serves as a reminder to the driver 30 that the fueling operation is ongoing. Upon completion of the fueling operation, the attendant uncouples the nozzle 24 from the filler neck 26, in the usual procedure followed in a conventional fueling operation, and then removes the safety device 40 from the windshield 34, indicating to the driver 30 that the fueling operation is complete and the automobile 20 is free to move away from the fueling station 22 with safety.

Figure 2:
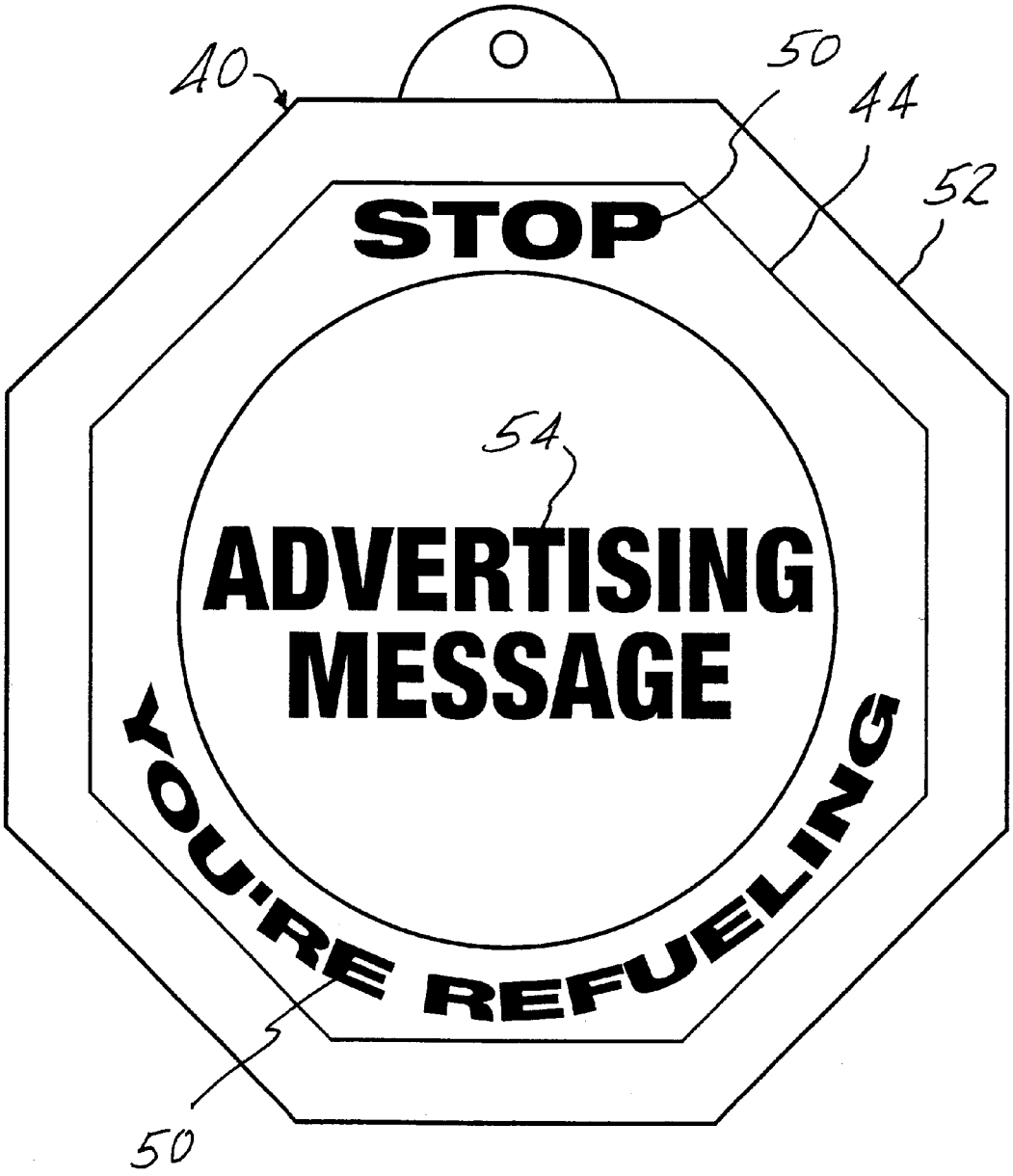
FIG. 2 is an illustration depicting the visual display of a vehicle fueling safety device constructed in accordance with the present invention.

As best seen in FIG. 2, the visual display 44 includes a message 50 advising the driver 30 that the automobile 20 must remain stopped during the fueling operation. The safety device 40 includes an overall peripheral shape 52, the preferred shape 52 being octagonal so as to resemble the standard symbol for a stop sign, further reinforcing the message 50 to emphasize that the automobile must remain stopped during fueling. As an additional feature, the visual display 44 includes an advertising message 54 which the driver 30 may find informative. Further, the visual display 44 may be furnished with other messages and visual devices which the driver 30 may find of interest, and by which the driver 30 may even be entertained during the ordinarily dull and uninteresting waiting time associated with a fueling operation.

Figure 3:
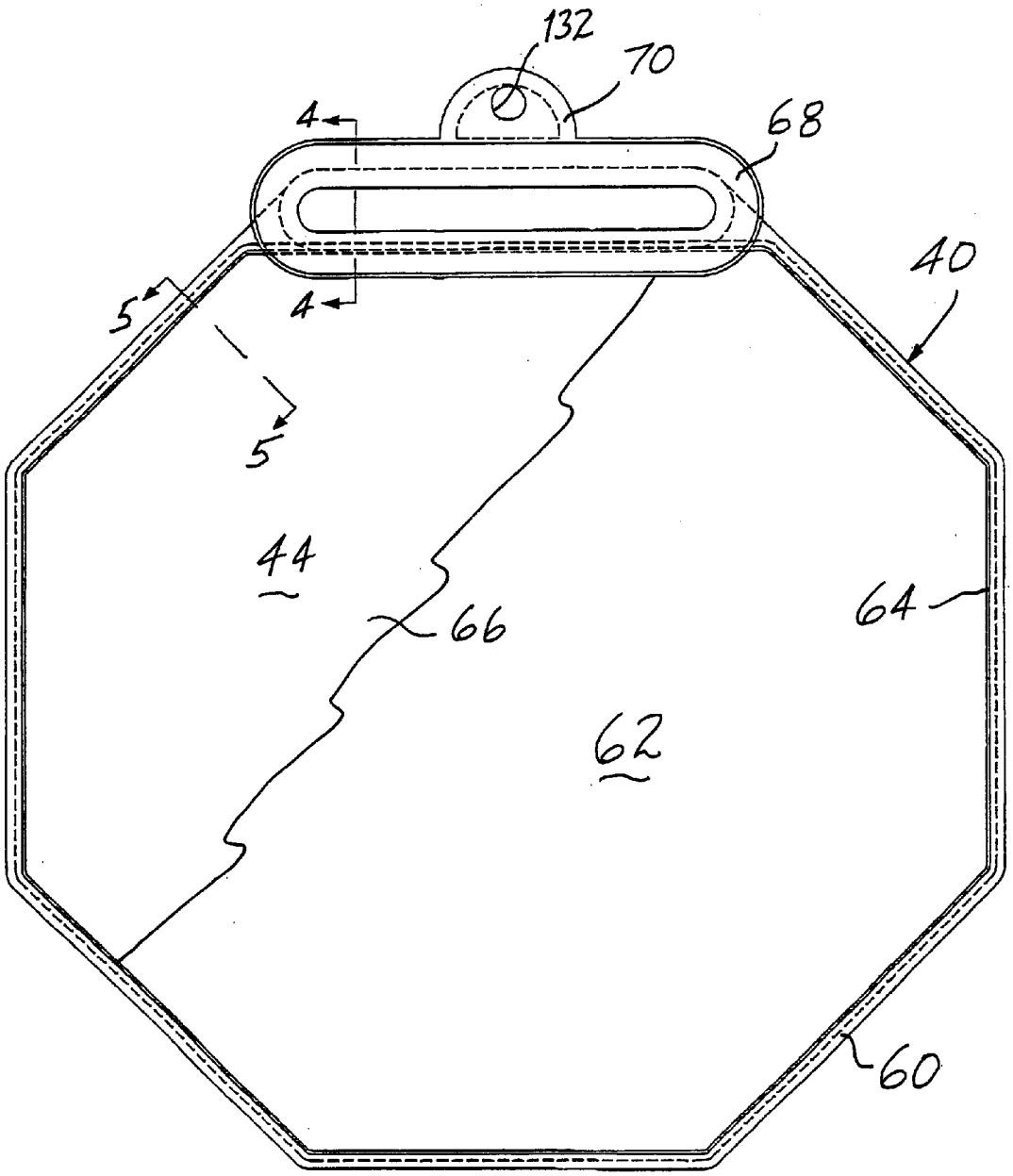
FIG. 3 is a front plan view showing the construction of the vehicle fueling safety device.
Figure 4:
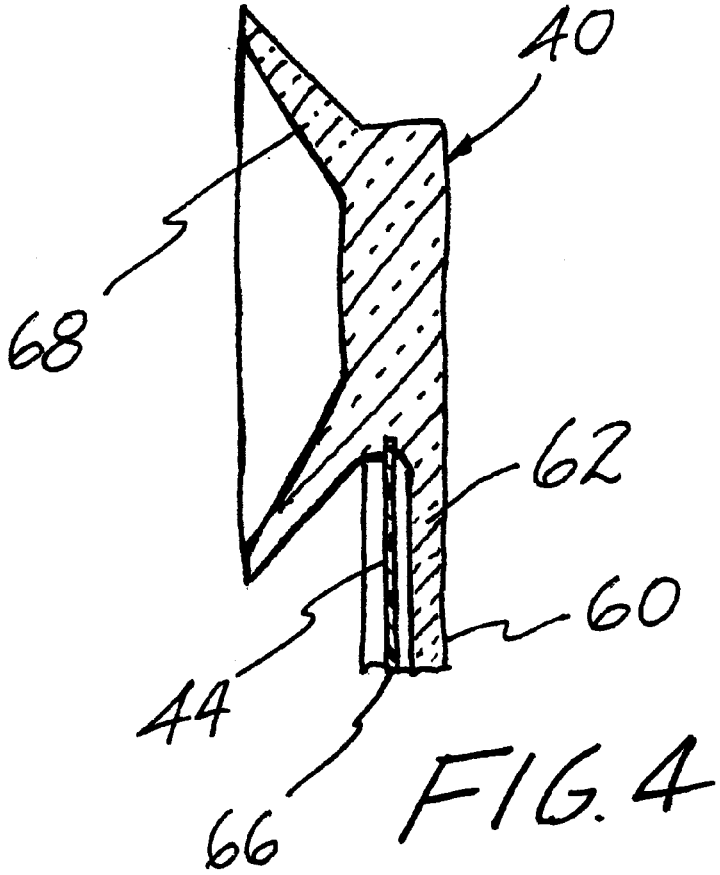
FIG. 4 is an enlarged fragmentary cross-sectional view taken along line 4—4 of FIG. 3.
Figure 5:
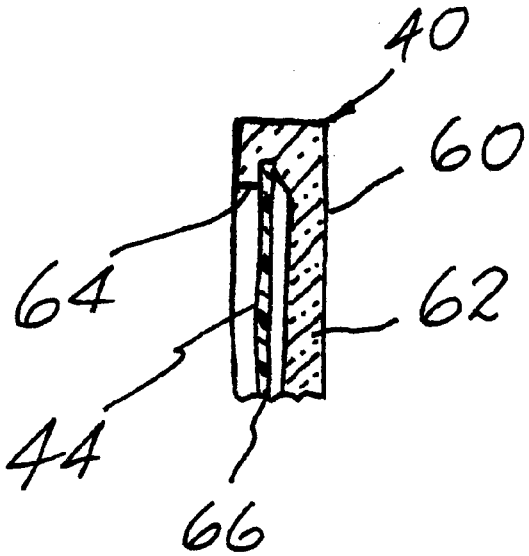
FIG. 5 is an enlarged fragmentary cross-sectional view taken along line 5—5 of FIG. 3.

Turning now to FIGS. 3 through 5, in a preferred construction, safety device 40 includes a frame member 60 having a back wall 62 and a coupling arrangement in the form of a peripheral lip 64 which retains a selectively interchangeable display member 66. The display member 66 bears the visual display 44, including messages 50 and 54, and is selectively placed and retained within the frame member 60 so as to be juxtaposed with the back wall 62 while displaying the messages 50 and 54 at the front of the safety device 40. Frame member 60 preferably is constructed of a conformable synthetic polymeric material so that the frame member 60 will conform to the contour of the outside surface 42 of windshield 34 when placed against windshield 34. A placement device for selectively placing the visual display 44 in the line-of-sight 46 is provided in the form of a suction cup 68 integral with the frame member 60 and preferably molded unitary,with the frame member 60. Suction cup 68 extends along a portion of the periphery of the frame member 60 and includes an elongate configuration providing sufficient holding strength to retain the safety device 40 securely in place upon the automobile 20 for the duration of the fueling operation, while enabling easy selective removal of the safety device 40 upon completion of the fueling operation. A tab 70 is integral with the frame member 60 adjacent the suction cup 68 for facilitating selective detachment of the suction cup 68 from the windshield 34. Preferably, the material of the frame member 60 is at least translucent so that ambient light is transmitted through the frame member 60 to the windshield 34 for facilitating viewing of the visual display 44 by the driver 30 and reducing any closed 152 in feeling on the part of the driver 30.

Figure 6:
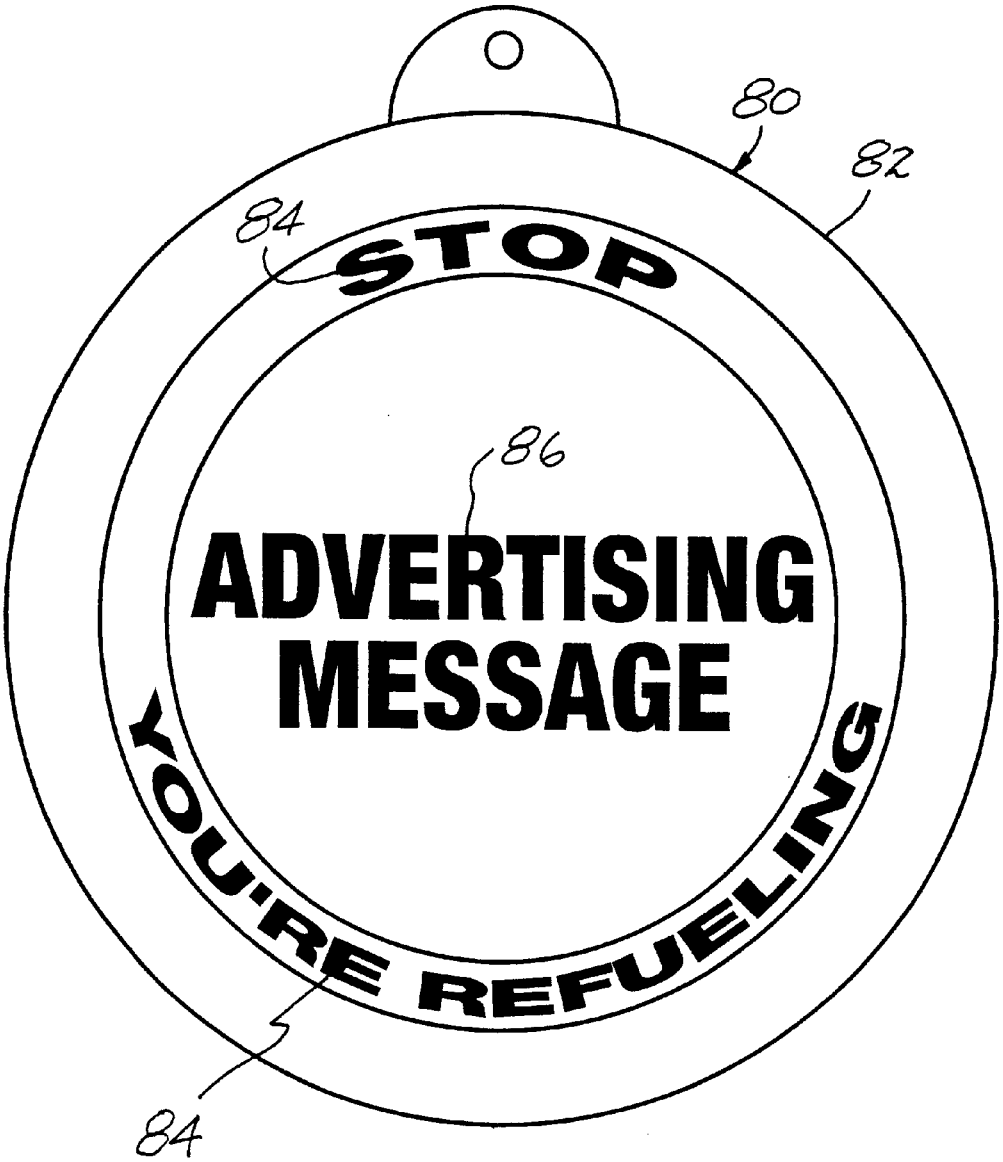
FIG. 6 is an illustration depicting the visual display of another vehicle fueling safety device constructed in accordance with the present invention.
Figure 7:
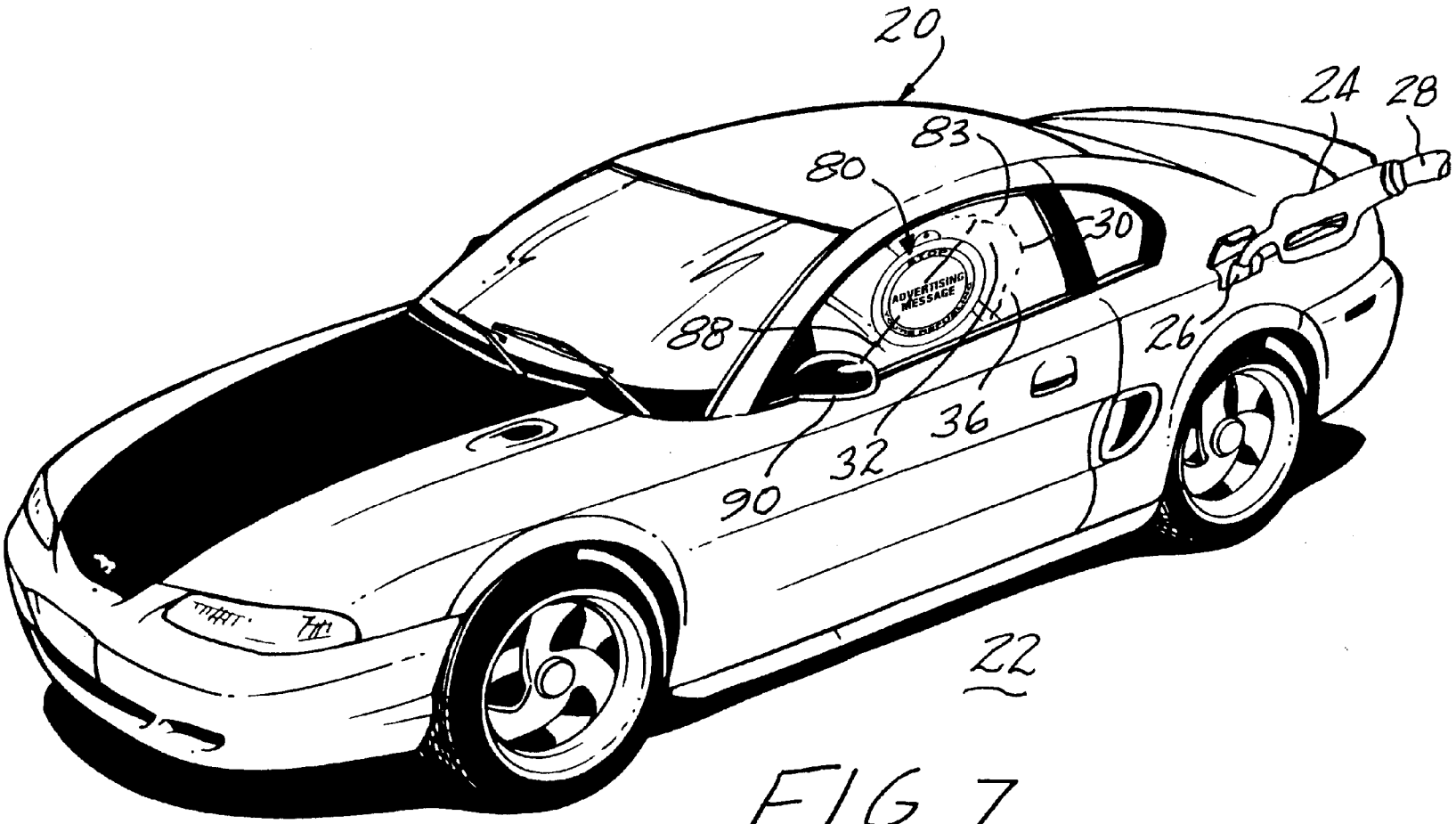
FIG. 7 is a pictorial view of the vehicle of FIG. 1, illustrating another application of the invention, in the form depicted in FIG. 6.

In FIGS. 6 and 7, an alternate safety device 80 is provided with a circular peripheral configuration 82 and is shown attached to the outside surface 83 of the side window 36 of automobile 20 so that the messages 84 and 86 carried by the safety device 80 are placed in a line-of-sight 88 extending from the driving position 32 through the side window 36 to a rear-view mirror 90 of the automobile 20. Thus, a driver 30 looking toward the rear-view mirror 90 will be reminded of the ongoing fueling operation and inadvertent premature departure of the automobile will be prevented.

Figure 8:
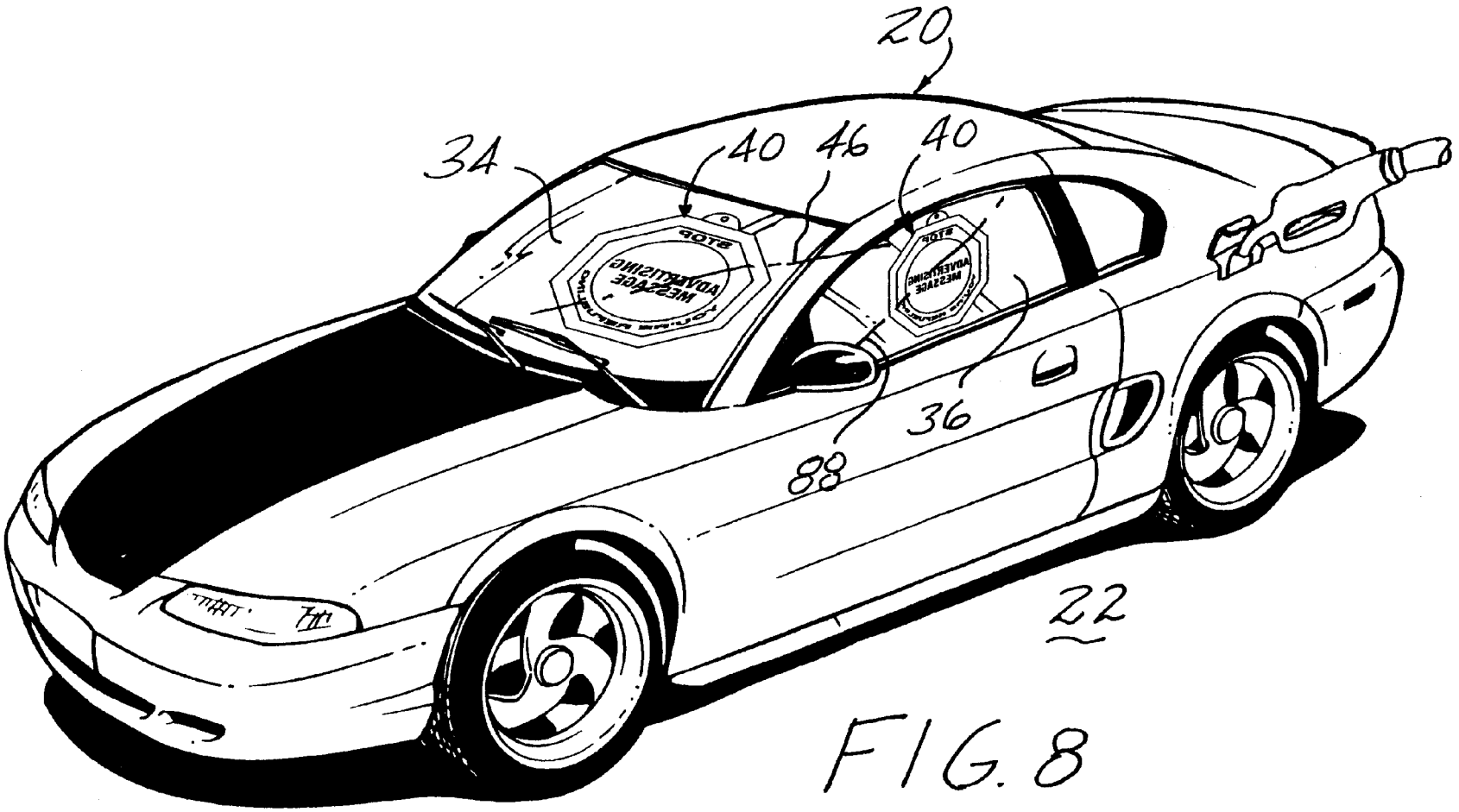
FIG. 8 is a pictorial view of the vehicle, illustrating still another application of the invention.

In FIG. 8, safety devices 40 have been placed against both the windshield 34 and the side window 36 of automobile 20 so as to provide a safety warning indication within both the line-of-sight 46 and the line-of-sight 88, for additional safety.

Figure 9:
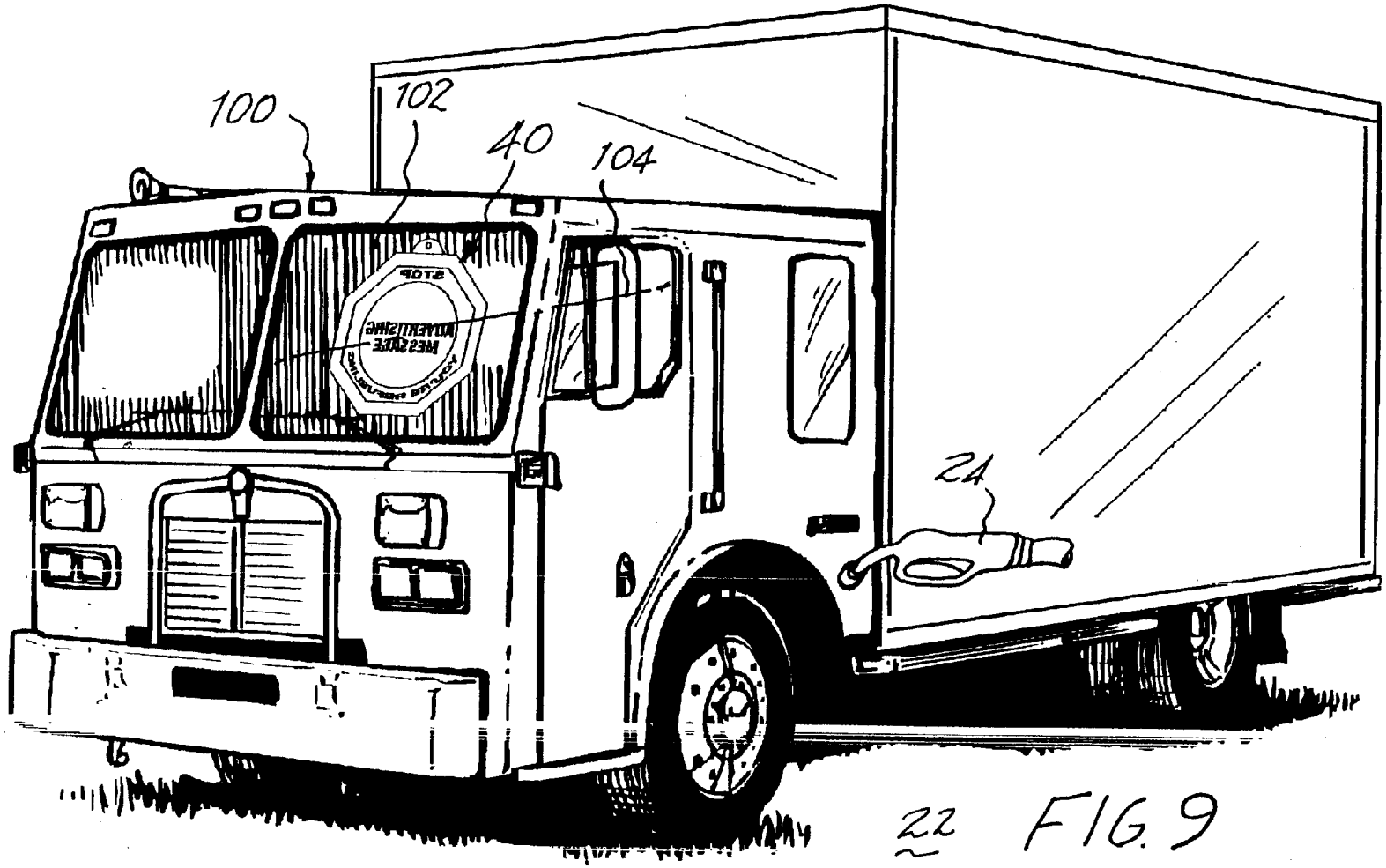
FIG. 9 is a pictorial view of another vehicle being fueled and illustrating another application of the present invention.

In FIG. 9, safety device 40 is shown in place during the fueling of a vehicle in the form of a truck 100. The safety device 40 is placed upon the windshield 102 of the truck 100, so as to be within the line-of-sight 104 extending through the windshield 102.

Figure 10:
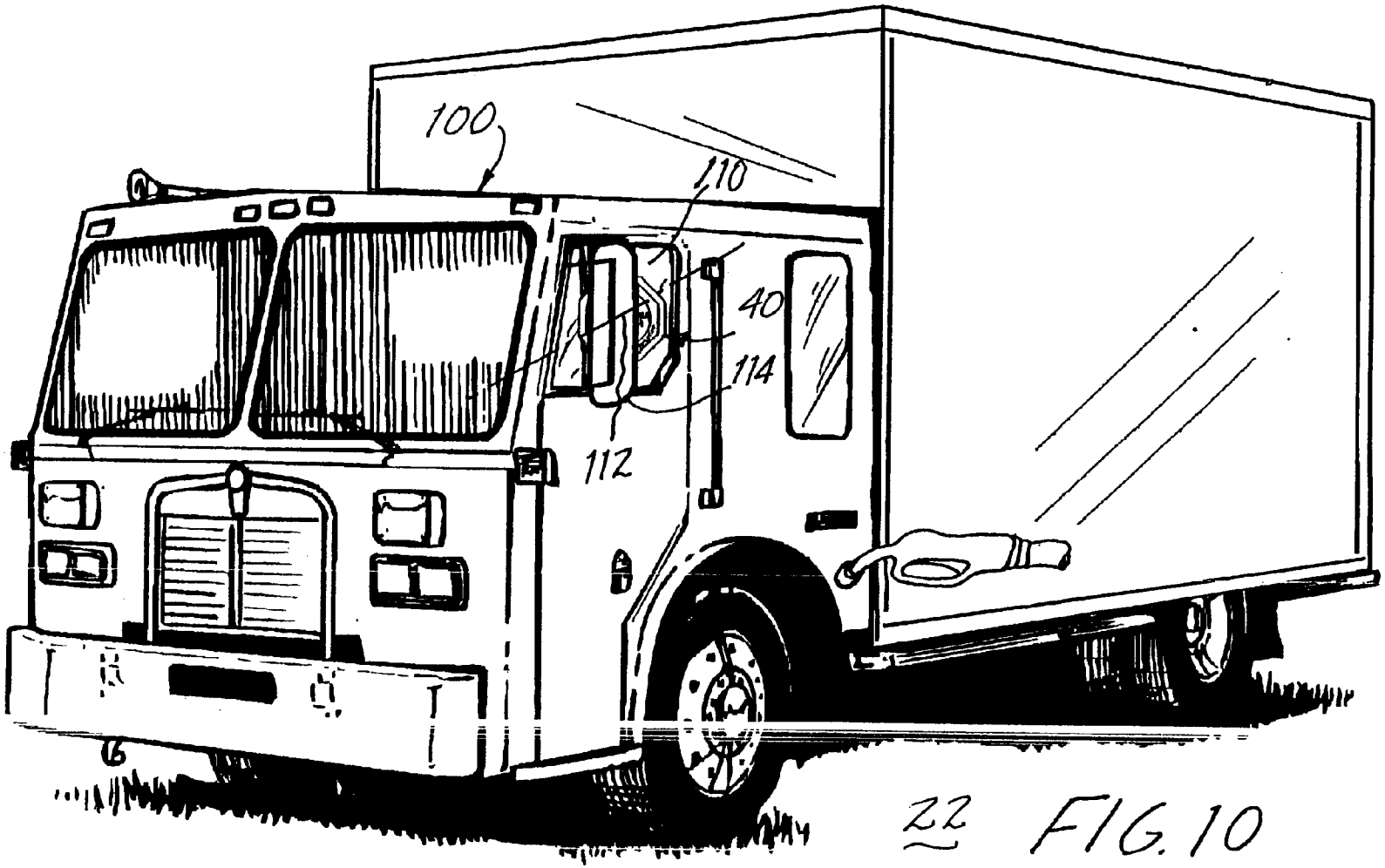
FIG. 10 is a pictorial view of the vehicle, illustrating yet another application of the invention.

In FIG. 10, the safety device 40 is shown in place against the side window lo of truck 100, while the truck 100 is being fueled. The safety device 40 thus is located within the line-of-sight 112 extending through the side window 110 to a rear-view mirror 114.

Figure 11:
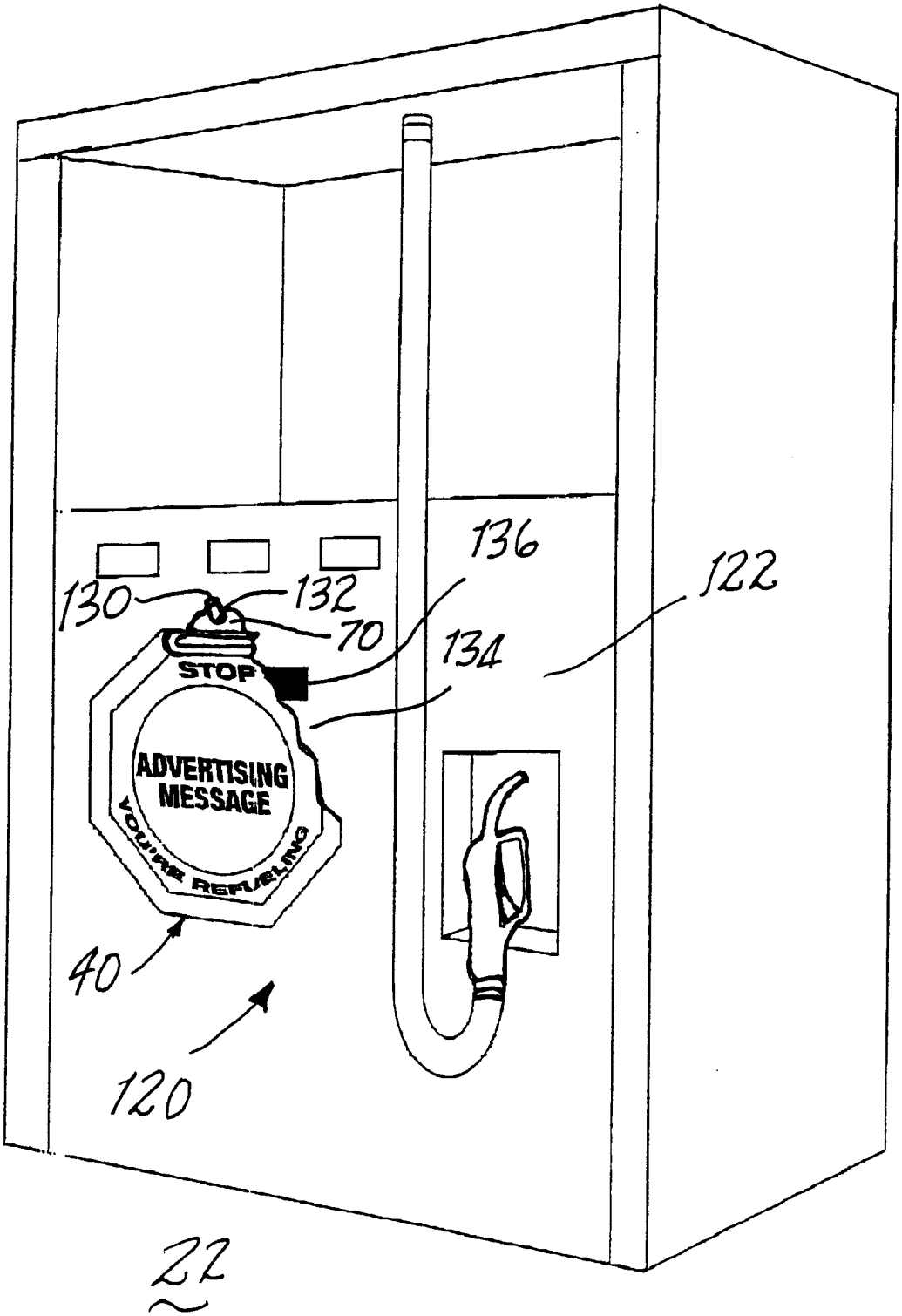
FIG. 11 is a pictorial view illustrating a vehicle fueling safety system constructed in accordance with the present invention.

Referring now to FIG. 11, a vehicle fueling safety system constructed in accordance with the present invention is shown at 120 and is seen to include the safety device 40. A fuel dispenser in the form of a fuel pump 122 is located at fueling station 22. System 120 includes a further placement device in the form of a peg 130 on the fuel pump 122 and an aperture 132 in tab 70 of the safety device 40 for being engaged by the pg 130 so that the safety device 40 is secured selectively to the fuel pump 122, at the peg 130, when the safety device 40 is not in use on a vehicle being fueled. The peg 130 provides an inactive location 134 outside and remote from the lines-of-sight described above for placement of the safety device 40 when not in use. A disabling arrangement at the inactive location 134 includes a disabling device shown in the form of a proximity detector 136 responsive to the presence of the safety device 40 at the inactive location 134 to disable the fuel pump 122 so that the fuel pump 122 cannot be operated to dispense fuel as long as the safety device 40 is present at the inactive location 134. Since the safety device 40 must be removed from the inactive location 134 in order to commence the fueling operation, the attendant at the fueling station 22 or, in the case of a self-serve operation, the driver of the vehicle to be fueled, will remove the safety device 40 and will be reminded to place the safety device 40 on the vehicle to be fueled upon commencement of the fueling operation.

It will be seen that the present invention attains the several objects and advantages summarized above; namely: Precludes inadvertent premature departure of a vehicle from a fueling station by reminding the driver of the vehicle that a fueling operation is incomplete and ongoing; places a visible reminder in the line-of-sight of the driver of a vehicle at a fueling station so as to deter premature departure of the vehicle; prevents hazardous conditions at a fueling station and eliminates damage to property and injury to people in the vicinity, which otherwise has been known to occur as a result of premature departure of a vehicle from a fueling station; provides an inexpensive system and method which require little if any modification of existing sites to reduce accidents resulting from the premature departure of a vehicle being fueled at a fueling station; presents a unique medium for advertising goods and services or for otherwise entertaining a driver during fueling of the driver's vehicle; provides a relatively simple and highly effective system and method for increasing safety at a fueling station with relatively little effort on the part of drivers or attendants at the fueling station; reduces hazards associated with premature departure of a vehicle from a fueling station; decreases losses associated with fueling operations by assuring completion of all transactions in the fueling operation before departure of a vehicle being fueled; provides increased safety and efficiency at both self-serve and attendant-operated vehicle fueling stations, for encouraging widespread adoption and use.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in a vehicle fueling system having a fueling station at which a vehicle is fueled, the improvement promoting safety by precluding inadvertent premature departure of the vehicle from the fueling station as a result of an action by an inattentive or distracted driver of the vehicle during an ongoing fueling operation at the fueling station, improvement including:

a visual warning indicator placed in a line-of-sight of the driver when the driver is in a driving position in the vehicle during an ongoing fueling operation for being viewed by the driver as a reminder of the ongoing fueling operation; and a placement device for selectively placing the visual warning indicator in the line-of-sight during the ongoing fueling operation, and for selectively removing the visual indicator from the line-of-sight upon completion of the ongoing fueling operation.

2. The improvement of claim 1 wherein the visual warning indicator comprises:

a frame member;

a selectively interchangeable display member; and a coupling arrangement for selectively coupling the display member with the frame member for viewing by the driver when the frame member is located so as to place the display member in the line-of-sight.

3. The improvement of claim 2 wherein the placement device includes a suction cup integral with the frame member for selectively securing the frame member to the vehicle during the ongoing fueling operation, and selectively removing the frame member from the vehicle upon completion of the ongoing fueling operation.

4. The improvement of claim 1 wherein the vehicle includes a window, the line-of-sight extends through the window, and the placement device includes a mounting arrangement for juxtaposing the visual warning indicator with the window, in the line-of-sight.

5. The improvement of claim 4 wherein the window is a vehicle windshield located adjacent the driving position, in the line-of-sight, and the mounting arrangement includes a mount for selectively securing the visual warning indicator in juxtaposition with the vehicle windshield, in the line-of-sight.

6. The improvement of claim 5 wherein the mount comprises a suction cup for selectively securing the visual warning indicator to the vehicle during the ongoing fueling operation, and selectively removing the visual warning indicator from the vehicle upon completion of the ongoing fueling operation.

7. The improvement of claim 4 wherein the visual warning indicator comprises:

a frame member;

a selectively interchangeable display member; and a coupling arrangement for coupling the display member with the frame member for viewing by the driver when the frame member is located so as to place the display member in the line-of-sight.

8. The improvement of claim 7 wherein the window has a given contour configuration and the frame member is comprised of a conformable material for conforming generally to the given contour configuration of the window when the visual warning indicator is placed in the line-of-sight.

9. The improvement of claim 7 wherein the trade member is comprised of a light-transmitting material for transmitting ambient light passing through the window when the visual warning indicator is placed in the line-of-sight.

10. The improvement of claim 9 wherein the placement device includes a suction cup integral with the frame member for selectively securing the frame member to the vehicle during the ongoing fueling operation, and for selectively removing the frame member from the vehicle upon completion of the ongoing fueling operation.

11. The improvement of claim 10 wherein the frame member is comprised of a conformable synthetic polymeric material and the suction cup is unitary with the frame member.

12. An improvement in a vehicle fueling system having a fueling station at which a vehicle fueled, the improvement promoting safety by precluding inadvertent premature departure of the vehicle from the fueling station as a result of an action by an inattentive or distracted driver of the vehicle during an ongoing fueling operation in which fuel is dispensed to the vehicle improvement including:

a fuel dispenser at the fueling station for dispensing fuel to the vehicle;

a visual warning indicator for being viewed by the driver as a reminder of the ongoing fueling operation;

a placement device for selectively placing the visual warning indicator in a line-of-sight of the driver when the driver is in a driving position in the vehicle during the ongoing fueling operation, and for selectively removing the visual indicator from the line-of-sight upon completion of the ongoing fueling operation;

a further placement device for placing the visual warning indicator at an inactive location outside the line-of-sight; and a disabling arrangement responsive to placement of the visual warning indicator at the inactive location for disabling the fuel dispenser to preclude the dispensing of fuel while the visual warning indicator is placed at the inactive location.

13. The improvement of claim 12 wherein the fuel dispenser includes a fuel pump for operation to dispense fuel, the inactive location is juxtaposed with the fuel pump, and the disabling arrangement includes a disabler responsive to the placement of the visual warning indicator at the inactive location to preclude operation of the fuel pump to dispense fuel.

14. A vehicle fueling safety method for precluding inadvertent premature departure of a vehicle from a fueling station as a result of an action by an inattentive or distracted driver of the vehicle during an ongoing fueling operation at the fueling station, the vehicle fueling safety method comprising the steps of:

providing a visual warning indicator for being viewed by the driver as a reminder of the ongoing fueling operation;

selectively placing the visual warning indicator in a line-of-sight of the driver when the driver is in a driving position in the vehicle during the ongoing fueling operation; and selectively removing the visual indicator from the line-of-sight upon completion of the ongoing fueling operation.

15. The method of claim 14 wherein the vehicle includes a window, the line-of-sight extends through the window, and the step of placing the visual warning indicator in the line-of-sight includes mounting the visual warning indicator on the vehicle, in juxtaposition with the window, in the line-of-sight.

16. The method of claim 15 wherein the window comprises a vehicle windshield located adjacent the driving position, in the line-of-sight, and the step of mounting the visual warning indicator on the vehicle includes mounting the visual warning indicator on the vehicle windshield, in the line-of-sight.

17. The method of claim 14 wherein during the fueling operation fuel is dispensed to the vehicle from a fuel dispenser, and the method includes the steps of:

locating the visual warning indicator at an inactive location outside the line-of-sight when the fueling operation is not ongoing; and disabling the fuel dispenser to preclude the dispensing of fuel while the visual warning indicator is at the inactive location.

18. The method of claim 17 wherein the step of disabling the fuel dispenser is effected in response to locating the visual warning indicator at the inactive location.

* * * * *